United States Patent [19]

Laput

[11] Patent Number: 4,905,764

[45] Date of Patent: Mar. 6, 1990

[54] PROTECTIVE COVER ASSEMBLY FOR A WELL CASING AND A METHOD OF PROTECTING A WELL CASING

[76] Inventor: William Laput, R.F.D. 1, Box 912 D, Margaret La., Plainfield, Conn. 06374

[21] Appl. No.: 376,396

[22] Filed: Jul. 6, 1989

[51] Int. Cl.[4] ..... E21B 33/00; E21B 41/00

[52] U.S. Cl. ..... 166/379; 166/94; 166/96; 166/381

[58] Field of Search ..... 166/92–97, 166/75.1, 356, 379, 380, 381

[56] References Cited

U.S. PATENT DOCUMENTS

| | | | |
|---|---|---|---|
| 3,063,500 | 11/1962 | Logan | 166/96 X |
| 3,318,377 | 5/1967 | Otteman | 166/75.1 X |
| 3,421,579 | 1/1969 | Manning | 166/356 |
| 3,512,583 | 5/1970 | James | 166/356 |
| 3,556,208 | 1/1971 | Dean | 166/75.1 X |
| 3,601,189 | 8/1971 | Weiss et al. | 166/356 |
| 3,602,301 | 8/1971 | James | 166/356 X |
| 4,842,060 | 6/1989 | Paulus | 166/75.1 |

FOREIGN PATENT DOCUMENTS

| | | | |
|---|---|---|---|
| 2035426 | 6/1980 | United Kingdom | 166/356 |

*Primary Examiner*—Stephen J. Novosad

*Attorney, Agent, or Firm*—McCormick, Paulding & Huber

[57] ABSTRACT

A protective cover assembly for a water well is provided. The cover assembly includes a cover member which covers and completely encloses the above ground projecting end portions of a well casing and an associated electrical conduit. The cover member has an annular skirt surrounding its lower end which is disposed below ground when the cover assembly is placed over the projecting end portions of the well casing and conduit.

17 Claims, 2 Drawing Sheets

PROTECTIVE COVER ASSEMBLY FOR A WELL CASING AND A METHOD OF PROTECTING A WELL CASING

BACKGROUND OF THE INVENTION

The present invention relates to a cover assembly for a well casing. More particularly, the present invention provides a protective cover assembly for the portion of a well casing disposed above ground. The present invention further provides a method for positioning the cover assembly over the well casing with the cover assembly extending and anchored below ground.

In areas where water is supplied from aquifiers located deep beneath ground level, water wells are commonly formed by boring to the appropriate depth for tapping the aquifier and then lining the bore with a circular steel casing. Generally, the steel casing has an inside diameter of six inches and projects from six inches to a few feet above the surface of the ground.

A submergible pump is lowered into the casing to the water level, and water is pumped up through a pipe or hose to a discharge connection located below the frost line. An electrical cable extends from the submerged pump, out the upper end of the casing, to an electrical conduit placed along side the casing. The conduit carries the cable back down along the outside of the well casing to a depth of a least a foot below ground and then under the ground to an electric supply.

The upper end of the casing must be closed to prevent foreign matter from entering the well and damaging the pump or electrical cable. A number of well closures are commercially available for this purpose; however, none of the designs presently in use completely encloses the portion of the well casing and its associated conduit which extend above ground level. Thus, with prior art well closures, a portion of the well casing and conduit is left exposed and subject to mechanical damage. Further, the metal well casing is exposed to damage by lightning. Finally, the projecting end of the casing and conduit present an eyesore, especially in the case of residential water wells.

Accordingly, it is an aim of the invention to provide a protective cover assembly which completely enclosed the portion of a well casing and an associated electrical conduit that extends above ground level.

It is a further aim of the invention to provide a cover asesmbly that protects the well casing and the pump and electrical cable it houses from damage by lightning.

It is a still further aim of the invention to provide a cover assembly that presents an attractive appearance.

SUMMARY OF THE INVENTION

The present invention meets the above-stated objects by providing a protective well cover assembly that completely encloses the above-ground projecting end portion of a well casing. The protective cover assembly comprises a hollow cover member having an axially elongated side wall and an end wall which forms a closure for the upper end of the cover member. The bottom end of the cover member is open and is surrounded by an annular skirt. The cover member has an axial length greater than the axial length of the projecting end portion of the well casing, and when the cover member is placed over the end portion the annular skirt is disposed below ground level.

The cover assembly further includes means for anchoring the cover member with the skirt below ground.

Such means may take the form of a projection on the annular skirt which maintains the cover member in spaced relationship to the end portion of the well casing when the skirt is buried. In a preferred embodiment of the invention, the projection is an annular flange which surrounds the skirt. In the most preferred form of the invention, at least one fastener mounted in the side wall to releasably engage the well casing is also provided.

The cover member is preferably made from a dielectric material to protect the well casing, the pump and the electrical cable from damage by lightning. In the most preferred embodiment of the invention, the cover member bears a decorative design on its outer surface, such as a clown face, or it is shaped as a decorative article, such as a mushroom or flower.

DETAILED DESCRIPTION OF THE INVENTION

Figure 1:
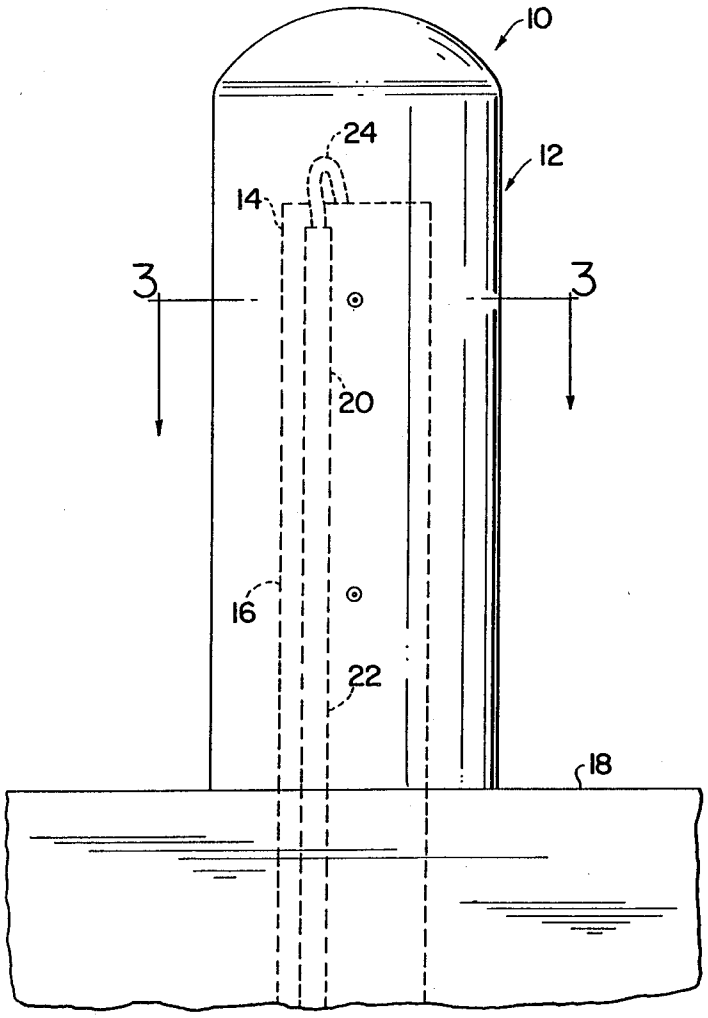
FIG. 1 is a side elevation of the cover assembly taught by the present invention positioned over the aboveground projecting end portion of a well casing.

FIG. 1 illustrates the protective cover assembly taught by the present invention. The cover assembly 10 comprises a hollow cover member 12 that completely encloses the above ground-projecting end portion 14 of a well casing 16 The cover member 12 further encloses the above ground-projecting end portion 20 of an electrical conduit 22 which carries an electrical cable 24 connecting a submerged pump (not shown) to an electric supply (not shown).

Figure 2:
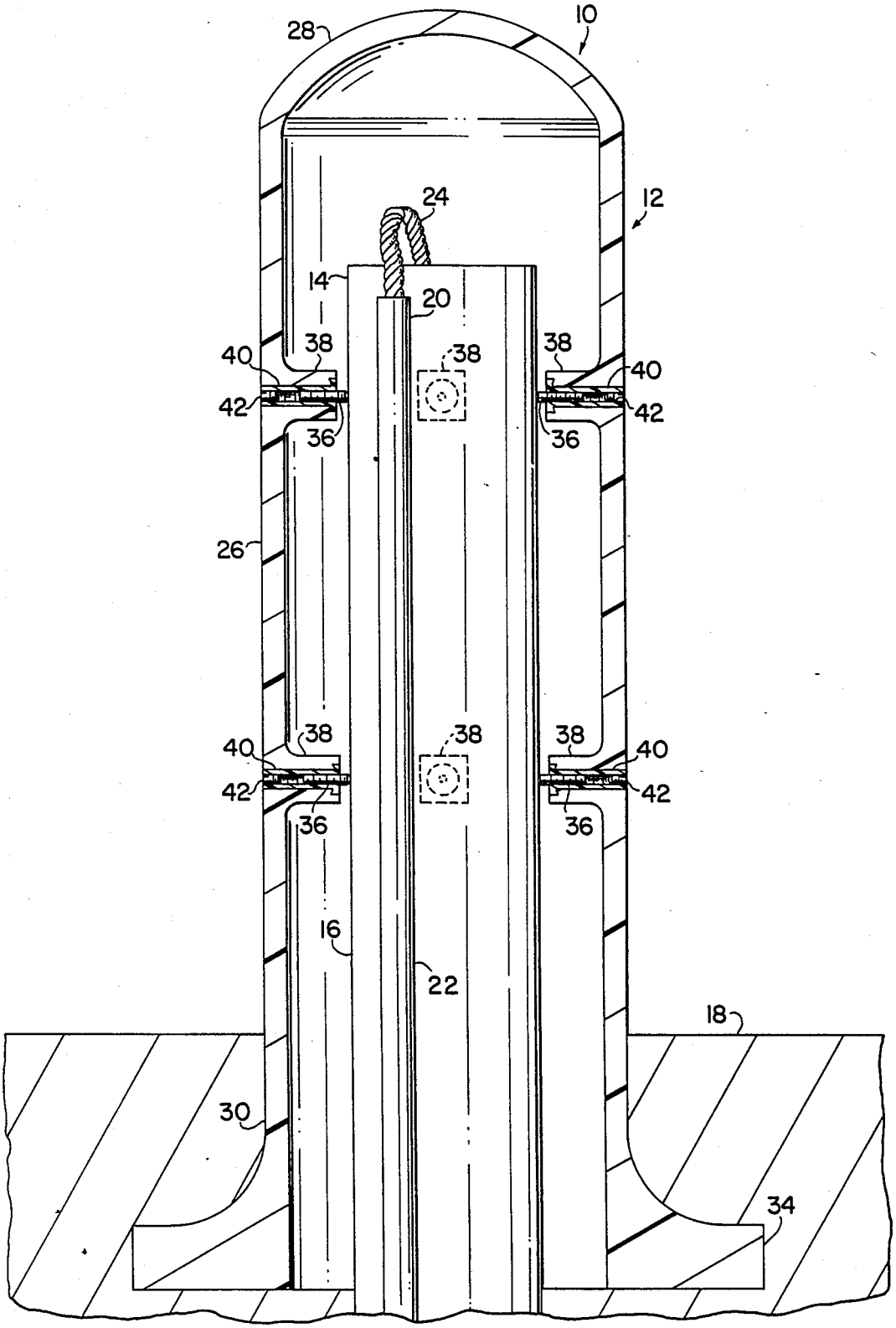
FIG. 2 is an axial section of the cover assembly shown in FIG. 1.

FIG. 2 illustrates the cover assembly 10 in greater detail. The hollow cover member 12 includes an axially elongated, generally cylindrical side wall 26 and an end wall 28 which forms a closure for the upper end of the cover member.

As illustrated in FIG. 2, the cover member 12 has an axial length substantially greater than the axial length of the projecting end portions 14 and 20. Thus, when the cover member is positioned over the well casing 16 and the conduit 22 such that the projecting end portions 14 and 20 are completely enclosed by the cover member, the annular skirt 30 is disposed below ground level 18. The skirt 30 is provided with an annular flange 34. The flange 34 anchors the cover member 12 firmly in the ground and in spaced relationship to the projecting end portions 14 and 20 when the cover assembly 10 is installed over the well casing in the manner set forth below.

Figure 3:
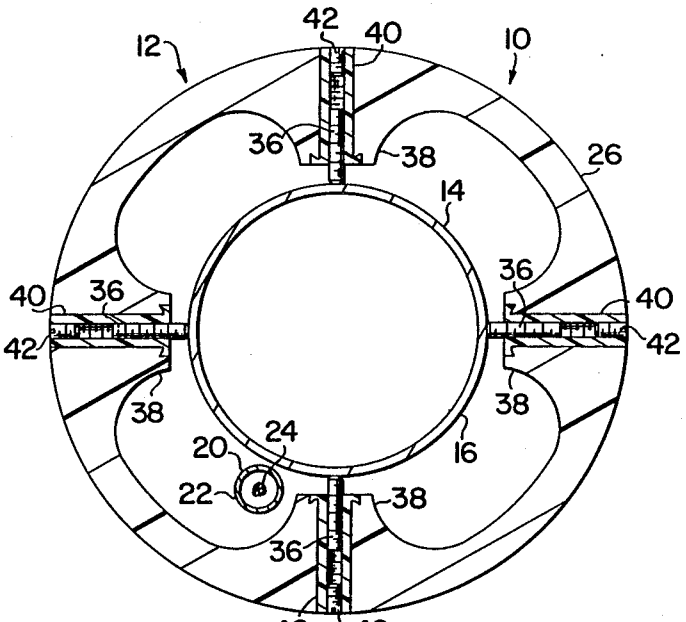
FIG. 3 is a cross section of the cover assembly shown in FIG. 1 taken along the line 3—3.

The cover assembly 10 further comprises a plurality of allen screws 36, 36 shown best in FIGS. 2 and 3, which engage the projecting end portion 14 of the well casing. The allen screws cooperate with the annular flange 34 to ensure that the cover member 12 remains firmly anchored in the ground in spaced relationship with the well casing. The allen screws are mounted in bosses 38, 38 formed in the side wall 26. Each boss is fitted with a threaded sleeve 40, 40 which threadably receives the allen screws. The screws are threaded into the sleeves until they extend beyond the bosses and engage the end portion 14. As will be explained below, the allen screws not only help ensure that the cover member 12 remains anchored in the ground, but the screws are also used to plumb the cover member with respect to the well casing.

As mentioned previously, the cover member 12 is preferably made from a dielectric material to protect the well casing, the pump and the cable from damage by lightening. To ensure that the entire exposed surface of the cover member 12 is non-conductive, cap screws 42, 42, made from a dielectric material such as nylon, are threaded into the outer end of the sleeves 40, 40. Since the nylon cap screws must be removed to access the allen screws 36, 36 the cap screws provide the additional function of improving the cover assembly's tamper resistance.

To install the cover assembly, a trench is dug around the casing to a depth of about eight inches. The cover assembly is then placed over the projecting end portions of the well casing and conduit and lowered until the skirt 30 seats in the bottom of the trench.

The allen screws 36, 36 are then threaded into the sleeves 40, 40 until the inner ends of the allen screws engage the end portion 14. Since the bottom of the trench may not be level and/or the outside diameter of the end portion 14 not uniform over its entire surface, the allen screws are threadably adjusted to compensate for such errors and plumb the cover assembly with respect to the end portion 14. This is especially important where the outside surface of the cover member bears a decorative design or takes the shape of a decorative article.

Once the cover assembly is adjusted on the well casing, the cap screws 42, 42 are threaded into the sleeves 40, 40 to cover the allen screws, and the trench surrounding the skirt 30 is filled in. After the skirt has been buried, the flange 34 and the allen screws 36, 36 ensure that the cover member remains firmly anchored in fixed space relationship to the projecting end portion 14.

While preferred embodiments have been shown and described, various modifications and substitutions may be made without departing from the spirit and scope of the invention. Accordingly, it is to be understood that the present invention has been described by way of example and not by limitation.

I claim:

1. A protective cover assembly for the above ground projecting end portion of a well casing, said cover assembly comprising:

a hollow axially elongated cover member, said cover member having a side wall and a end wall forming a closure for the upper end of said cover member, said cover member having an axial length substantially greater than the axial length of the projecting end portion and an opening at its lower end for receiving the projecting end portion there through, said cover member having an annular skirt at its lower end surrounding an opening communicating with said hollow cover member, said skirt disposed below ground level when said cover member is positioned over and in covering relation to the projecting end portion, and means for anchoring said cover member in spaced relationship to said end portion with said skirt below ground level.

2. A protective cover assembly as set forth in claim 1 wherein said means for anchorage said cover member in spaced relationship to said end portion with said skirt below ground level comprises a projection on said annular skirt.

3. A protective cover assembly as set forth in claim 1 wherein said means for anchoring said cover member in spaced relationship to said end portion with said skirt below ground level comprises an annular flange projecting outwardly from said skirt.

4. A protective cover assembly as set forth in claim 1 wherein said means for anchoring cover member in spaced relationship to said end portion with said skirt below ground level comprises at least one fastener mounted in said side wall to releasably engage said end portion.

5. A protective cover assembly as set forth in claim 1 wherein said means for anchoring cover member in spaced relationship to said end portion with said skirt below ground level comprises a projection on said annular skirt and at least one fastener mounted in said side wall to releasably engage said end portion.

6. A protective cover assembly as set forth inn claim 5 wherein said projection on said annular skirt is an annular flange.

7. A protective cover assembly as set forth in claim 1 wherein said assembly is formed from a dielectric material.

8. A protective cover assembly as set forth in claim 4 wherein at least one boss is formed in said side wall and said fastener is mounted in said boss to releasably engage said end portion.

9.-A cover assembly as set forth in claim 8 wherein said at least one fastener is an allen screw.

10. A cover assembly as set forth in claim 9 wherein said at least one boss further includes a threaded sleeve for threadably receiving said allen screw.

11. A cover assembly as set forth in claim 10 wherein said threaded sleeve has an inner end positioned generally adjacent the projecting end portion and an outer end positioned adjacent the side wall and each one of said allen screws has an associated cap screw, said cap screw threadably received within said threaded sleeve at its outer end.

12. A protective cover assembly as set forth in claim 1 wherein said well casing has an associated electrical conduit having an above ground projecting end portion and said cover member is positioned over and in covering relation to the projecting end portion of the well casing and the projecting end portion of the electrical conduit.

13. A protective cover assembly as set forth in claim 1 wherein the outer surface of said cover member bears a decorative design.

14. A protective cover assembly and set forth in claim 1 wherein said cover member is shaped as a decorative article.

15. A protective cover assembly for the above groundprojecting end portion of a well casing, said cover assembly comprising;

a hollow axially elongated cover member made from a dielectric material, said cover member having a side wall and an end wall forming a closure for the upper end of said cover member, said cover member having an axial length substantially greater than the axial length of the projecting end portion and an opening at its lower end for receiving the projecting end portion there through, said cover member having an annular skirt at its lower end surrounding an opening communicating with said hollow cover member, said skirt disposed below ground level when said cover member is positioned over and in covering relation to the projecting end portion;

an annular flange projecting from said annular skirt to anchor said cover member with said skirt below ground level and to maintain said side wall in spaced relationship with said projecting end portion;

a plurality of bosses formed in said side wall, each one of said bosses including a threaded sleeve, said sleeve having an inner end positioned generally adjacent the projecting end portion and an outer end positioned adjacent the side wall; an allen screw threadably received within said sleeve and extending beyond said inner end to releasably engage said projecting end portion, said allen screws cooperating with said annular flange to anchor said cover member with said skirt below ground level and to maintain said side wall in spaced relationship with said projecting end portion, and a nylon cap screw threadably received within the outer end of said sleeve.

16. A method for protecting the above ground-projecting end portion of a well casing comprising the steps of:

providing a hollow axially elongated cover member having an axial length greater than the axial length of projecting end portion, said cover member made from a dielectric material and having a side wall, and end wall and an annular skirt at its lower end surrounding an opening communicating with said hollow cover member;

digging a trench around said well casing;

positioning said cover member over and in covering relation to said projecting end portion with said skirt disposed within said trench and below ground level, and back filling said trench around said skirt to anchor the cover member in the ground in spaced relation to the projecting end portion.

17. A method for protecting the above ground projecting end portion of a well casing as set forth in claim 16 including the additional step of securing the cover member in covering relation to the projecting end portion, the step of securing to be performed before the step of back filling.

* * * * *